US006211493B1

(12) United States Patent
Bouman

(10) Patent No.: US 6,211,493 B1
(45) Date of Patent: Apr. 3, 2001

(54) ICE PREVENTION MAT SYSTEM

(76) Inventor: Geni F. Bouman, 4066 St. Clair Pkwy., Port Lambton, Ontario (CA), N0P 2B0

( * ) Notice: Subject to any disclaimer, the term of this patent is extended or adjusted under 35 U.S.C. 154(b) by 0 days.

(21) Appl. No.: 09/490,987

(22) Filed: Jan. 26, 2000

(51) Int. Cl.[7] ..... H05B 1/00
(52) U.S. Cl. ..... 219/213; 219/528; 219/549
(58) Field of Search ..... 219/211, 212, 219/213, 217, 528, 539, 544, 548, 549

(56) References Cited

U.S. PATENT DOCUMENTS

| | | | | |
|---|---|---|---|---|
| 2,844,696 | * | 7/1958 | Custer, Jr. | 219/217 |
| 3,193,664 | | 7/1965 | Beery | 219/549 |
| 3,209,128 | | 9/1965 | Chapman, Jr. | 219/528 |
| 3,236,991 | | 2/1966 | Graham et al. | 219/213 |
| 3,716,076 | * | 2/1973 | Franzmeier | 219/213 |
| 3,812,320 | | 5/1974 | Borgren | 219/213 |
| 3,904,847 | | 9/1975 | Adams | 219/213 |
| 3,961,157 | * | 6/1976 | Miller et al. | 219/213 |
| 3,976,855 | | 8/1976 | Altmann et al. | 219/532 |
| 4,564,745 | * | 1/1986 | Deschenes | 219/213 |
| 4,922,084 | * | 5/1990 | Hutter | 219/549 |
| 4,967,057 | * | 10/1990 | Bayless et al. | 219/213 |
| 5,003,157 | * | 3/1991 | Hargrove | 219/213 |
| 5,291,000 | * | 3/1994 | Hornberger | 219/539 |
| 5,380,988 | * | 1/1995 | Dyer | 219/548 |
| 5,550,349 | * | 8/1996 | Bomba | 219/213 |
| 5,550,350 | * | 8/1996 | Barnes | 219/213 |
| 5,763,858 | * | 6/1998 | Jones | 219/213 |
| 6,051,811 | * | 4/2000 | Hardison | 219/213 |
| 6,092,587 | * | 7/2000 | Ingram | 219/544 |

* cited by examiner

*Primary Examiner*—Teresa Walberg
*Assistant Examiner*—Fadi H. Dahbour
(74) *Attorney, Agent, or Firm*—Joseph N. Breaux

(57) ABSTRACT

An ice prevention mat system that includes multiple resilient electrically heatable mats that are positionable to cover a desired pathway and which includes a control circuit for maintaining each of the electrically heatable mats at a temperature sufficient to melt snow falling on the mat as well as to prevent the formation of ice on the mat top surface. Each of the multiple resilient electrically heatable mats has a top surface partially covered a non skid or slip coating as well as light assemblies along the side borders to clearly identify the side edges of the mats.

1 Claim, 2 Drawing Sheets

ICE PREVENTION MAT SYSTEM

TECHNICAL FIELD

The present invention relates to safety equipment and more particularly to an ice prevention mat system for preventing the accumulation of ice and snow on footpaths, driveways, basketball courts, etc. that includes multiple resilient heatable mats, multiple rigid plastic light assemblies, a radio transmitter remote control unit and a control/power circuit housing for housing a programmable control circuit, a radio receiver and a remote code set switch and in connection with two two-conductor light assembly sockets and one three-conductor heating element and temperature sensor socket; each of the multiple resilient heatable mats including a resilient pad member having a resistance heating element and a temperature sensor embedded therein and electrically connectable via a plug socket assembly and a jumper block for electrically linking the last resistance heating element into connection with a heat return conductor, a pair of light assembly receiving slots on opposed sides of the resilient pad member each having an open top and shaped to slidingly receive into an open slot end thereof one of the multiple rigid plastic light assemblies and prevent lateral removal of the rigid plastic light assembly through the open top, a number of drainage grooves formed into the bottom surface of the resilient pad member and a number of non-skid areas on the top surface of the resilient pad member between the pair of light assembly receiving slots; each of the multiple resilient pad members being rollable into a roll for storage when no rigid plastic light assemblies are positioned within the light assembly receiving slots thereof; the radio transmitter remote control unit transmitting activation and deactivation codes on a predetermined radio frequency in response to depression of a remote activation switch; the programmable control circuit being in electrical connection with the temperature sensor and the heating element through the three-conductor heating element and temperature sensor socket, a remote code set switch for allowing a user to select activation and deactivation codes, the radio receiver tuned to the predetermined radio frequency, and two of the light assemblies using the two two-conductor light assembly sockets; the programmable control circuit being programmed to monitor the radio receiver for activation and deactivation codes and to turn on the light outputs when a light activation signal is received and to turn off the light outputs when a deactivation signal is received; the programmable control circuit being further programmed to monitor a temperature signal generated by the temperature sensor when the on/off switch is in the on position and to activate the heat output when the temperature signal is below a threshold trigger temperature that is greater than the freezing temperature of water and to deactivate the heat output when the temperature signal is above the threshold trigger temperature.

BACKGROUND ART

Many individuals are injured each year from slipping on snow covered or icy pathways. Although shoveling can remove the snow from the pathway, it requires a large amount of work which many infirm individuals are unable to perform. It would be benefit to these individuals to have an ice prevention mat system that included multiple resilient electrically heatable mats that could be positioned to cover the desired pathway and which included a control circuit for maintaining each of the electrically heatable mats at a temperature sufficient to melt snow falling on the mat as well as to prevent the formation of ice on the mat top surface. Because water, snow and sleet can be slippery, it would be further benefit to have an ice prevention mat system that included multiple resilient electrically heatable mats wherein the top surface of each matt included a non skid or slip coating on portions thereof as well as light assemblies along the borders to clearly identify the side edges of the mats.

GENERAL SUMMARY DISCUSSION OF INVENTION

It is thus an object of the invention to provide an ice prevention mat system that includes multiple resilient heatable mats, multiple rigid plastic light assemblies, a radio transmitter remote control unit and a control/power circuit housing for housing a programmable control circuit, a radio receiver and a remote code set switch and in connection with two two-conductor light assembly sockets and one three-conductor heating element and temperature sensor socket; each of the multiple resilient heatable mats including a resilient pad member having a resistance heating element and a temperature sensor embedded therein and electrically connectable via a plug socket assembly and a jumper block for electrically linking the last resistance heating element into connection with a heat return conductor, a pair of light assembly receiving slots on opposed sides of the resilient pad member each having an open top and shaped to slidingly receive into an open slot end thereof one of the multiple rigid plastic light assemblies and prevent lateral removal of the rigid plastic light assembly through the open top, a number of drainage grooves formed into the bottom surface of the resilient pad member and a number of non-skid areas on the top surface of the resilient pad member between the pair of light assembly receiving slots; each of the multiple resilient pad members being reliable into a roll for storage when no rigid plastic light assemblies are positioned within the light assembly receiving slots thereof; the radio transmitter remote control unit transmitting activation and deactivation codes on a predetermined radio frequency in response to depression of a remote activation switch; the programmable control circuit being in electrical connection with the temperature sensor and the heating element through the three-conductor heating element and temperature sensor socket, a remote code set switch for allowing a user to select activation and deactivation codes, the radio receiver tuned to the predetermined radio frequency, and two of the light assemblies using the two two-conductor light assembly sockets; the programmable control circuit being programmed to monitor the radio receiver for activation and deactivation codes and to turn on the light outputs when a light activation signal is received and to turn off the light outputs when a deactivation signal is received; the programmable control circuit being further programmed to monitor a temperature signal generated by the temperature sensor when the on/off switch is in the on position and to activate the heat output when the temperature signal is below a threshold trigger temperature that is greater than the freezing temperature of water and to deactivate the heat output when the temperature signal is above the threshold trigger temperature.

Accordingly, an ice prevention mat system is provided. The ice prevention mat system includes multiple resilient heatable mats, multiple rigid plastic light assemblies, a radio transmitter remote control unit and a control/power circuit housing for housing a programmable control circuit, a radio receiver and a remote code set switch and in connection with two two-conductor light assembly sockets and one three-conductor heating element and temperature sensor socket;

each of the multiple resilient heatable mats including a resilient pad member having a resistance heating element and a temperature sensor embedded therein and electrically connectable via a plug socket assembly and a jumper block for electrically linking the last resistance heating element into connection with a heat return conductor, a pair of light assembly receiving slots on opposed sides of the resilient pad member each having an open top and shaped to slidingly receive into an open slot end thereof one of the multiple rigid plastic light assemblies and prevent lateral removal of the rigid plastic light assembly through the open top, a number of drainage grooves formed into the bottom surface of the resilient pad member and a number of non-skid areas on the top surface of the resilient pad member between the pair of light assembly receiving slots; each of the multiple resilient pad members being rollable into a roll for storage when no rigid plastic light assemblies are positioned within the light assembly receiving slots thereof; the radio transmitter remote control unit transmitting activation and deactivation codes on a predetermined radio frequency in response to depression of a remote activation switch; the programmable control circuit being in electrical connection with the temperature sensor and the heating element through the three-conductor heating element and temperature sensor socket, a remote code set switch for allowing a user to select activation and deactivation codes, the radio receiver tuned to the predetermined radio frequency, and two of the light assemblies using the two two-conductor light assembly sockets; the programmable control circuit being programmed to monitor the radio receiver for activation and deactivation codes and to turn on the light outputs when a light activation signal is received and to turn off the light outputs when a deactivation signal is received; the programmable control circuit being further programmed to monitor a temperature signal generated by the temperature sensor when the on/off switch is in the on position and to activate the heat output when the temperature signal is below a threshold trigger temperature that is greater than the freezing temperature of water and to deactivate the heat output when the temperature signal is above the threshold trigger temperature.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
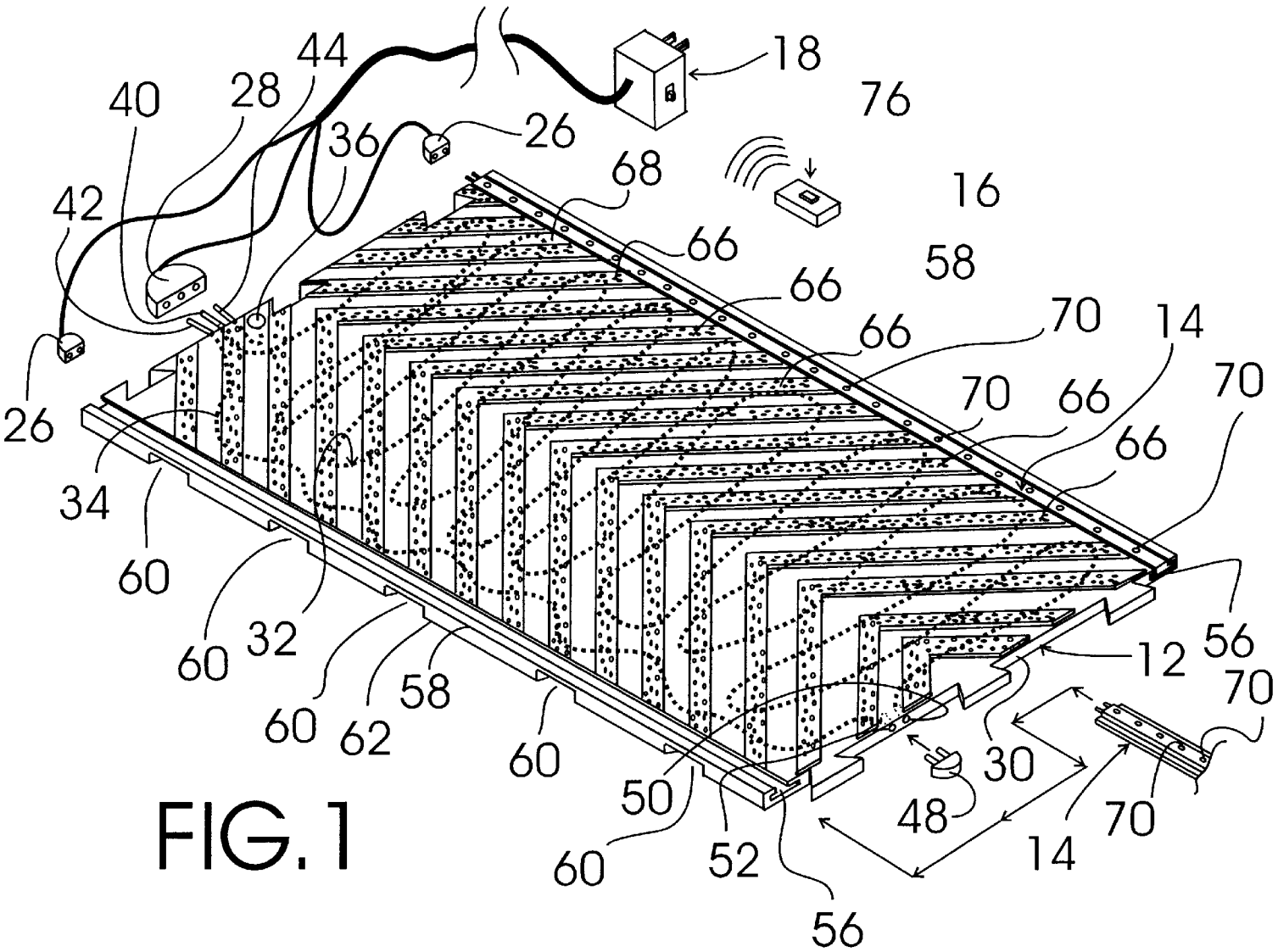
FIG. 1 is a partially exploded view of an exemplary embodiment of the ice prevention mat system of the present invention showing one of the multiple resilient heatable mats, two of the multiple plastic light assemblies, a radio transmitter remote control unit and a control/power circuit housing for housing a programmable control circuit, a radio receiver and a remote code set switch and in connection with two two-conductor light assembly sockets and one three-conductor heating element and temperature sensor socket; each of the multiple resilient heatable mats including a resilient pad member having a resistance heating element and a temperature sensor embedded therein and electrically connectable via a plug socket assembly and a jumper block for electrically linking the final resistance heating element into connection with the heat return conductor, a pair of light assembly receiving slots on opposed sides of the resilient pad member, a number of drainage grooves formed into the bottom surface of the resilient pad member and a number of non-skid areas on the top surface of the resilient pad member between the pair of light assembly receiving slots; the radio transmitter remote control unit transmitting activation and deactivation codes on a predetermined radio frequency; the programmable control circuit being in electrical connection with the temperature sensor, a remote code set switch for allowing a user to select activation and deactivation codes and the radio receiver tuned to the predetermined radio frequency; the programmable control circuit being programmed to monitor the radio receiver for activation and deactivation codes and to turn on the light outputs when a light activation signal is received and to turn off the light outputs when a deactivation signal is received; the programmable control circuit being further programmed to monitor a temperature signal generated by the temperature sensor when the on/off switch is in the on position and to activate the heat output when the temperature signal is below a threshold trigger temperature and to deactivate the heat output when the temperature signal is above the threshold trigger temperature.
Figure 2:
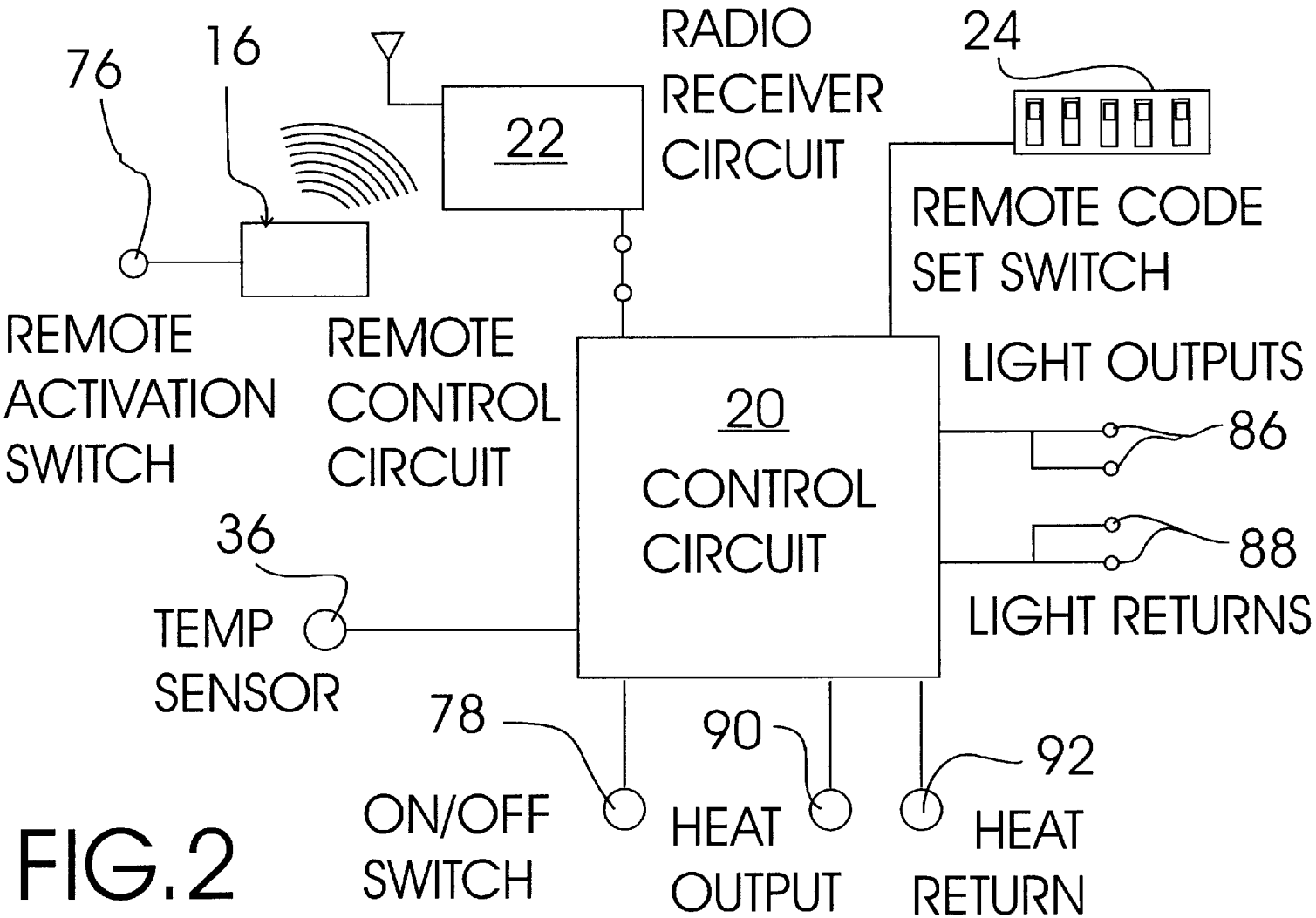
FIG. 2 is a schematic diagram showing the programmable control circuit, the remote code set switch, the light outputs, the light returns, the heat output, the heat return, the two-position on/off switch, the temperature sensor, the radio receiver circuit and the remote control circuit including the remote activation switch.

FIG. 1 shows an exemplary embodiment of the ice prevention mat system of the present invention, generally designated 10. Ice prevention mat system 10 includes multiple identical, resilient heatable mats, generally designated 12; multiple plastic light assemblies, generally designated 14; a radio transmitter remote control unit, generally designated 16; and a control/power circuit housing, generally designated 18, for housing, with reference now also to FIG. 2, a programmable control circuit, generally designated 20; a radio receiver circuit, generally designated 22; and a remote code set switch, generally designated 24, and in connection with two two-conductor light assembly sockets 26 and one three-conductor heating element and temperature sensor socket 28.

Each of the multiple resilient heatable mats 12 includes a resilient rubber pad member 30 having a resistance heating element 32, a heater return line 34 and a temperature sensor 36 embedded therein and electrically connectable to control circuit 20 via plug blades 40,42,44, respectively, with three-conductor heating element and temperature sensor socket 28. The last heatable mat 12 has a jumper block 48 inserted into mat sockets 50,52 to complete the electrical circuit between the serially connected heating elements 32 and the serially connected heater return lines 34.

Each resilient heatable mat 12 has a pair of T-cross sectional shaped light assembly receiving slots 56 on opposed sides 58 of resilient pad member 12, a number of drainage grooves 60 formed into the bottom surface 62 of resilient pad member 12 and a number of non-skid areas 66 on a top surface 68 of resilient pad member 12 between the pair of light assembly receiving slots 56. Each plastic light assembly 14 is T-shaped to fit into one of the T-cross sectional shaped light assembly receiving slots 56 and includes a number of high brightness LEDs 70 (light emitting diodes) spaced along the length thereof.

Radio transmitter remote control unit 16 transmits activation and deactivation codes on a predetermined radio frequency in response to depression of a remote activation switch 76. Programmable control circuit 20 is turned on and off by a two-position on/off witch 78 and is in electrical connection with temperature sensor 36, remote code set switch 24 for allowing a user to select activation and deactivation codes and the radio receiver 22 tuned to the predetermined radio frequency. The programmable control circuit 20 is programmed to monitor the radio receiver 22 for activation and deactivation codes and to turn on the light outputs 86 and light returns 88 when a light activation signal is received and to turn off the light outputs 86 and light returns 88 when a deactivation signal is received. Programmable control circuit 20 also being programmed to monitor a temperature signal generated by temperature sensor 36 when on/off switch 78 is in the on position and to activate the heat output 90 and heat return 92 when the temperature signal is below a threshold trigger temperature, in this case forty-five degrees Fahrenheit and to deactivate the heat output 90 and heat return 92 when the temperature signal is above the threshold trigger temperature.

It can be seen from the preceding description that an ice prevention mat system has been provided.

It is noted that the embodiment of the ice prevention mat system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An ice prevention mat system comprising:

multiple resilient heatable mats;

multiple rigid plastic light assemblies;

a radio transmitter remote control unit; and a control/power circuit housing housing a programmable control circuit, a radio receiver and a remote code set switch and in connection with two two-conductor light assembly sockets and one three-conductor heating element and temperature sensor socket;

each of said multiple resilient heatable mats including a resilient pad member having a resistance heating element and a temperature sensor embedded therein and electrically connectable via a plug socket assembly and a jumper block for electrically linking said last resistance heating element into connection with a heat return conductor, a pair of light assembly receiving slots on opposed sides of said resilient pad member each having an open top and shaped to slidingly receive into an open slot end thereof one of said multiple rigid plastic light assemblies and prevent lateral removal of said rigid plastic light assembly through said open top, a number of drainage grooves formed into a bottom surface of said resilient pad member and a number of non-skid areas on a top surface of said resilient pad member between said pair of light assembly receiving slots;

each of said multiple resilient pad members being rollable into a roll for storage when no rigid plastic light assemblies are positioned within said light assembly receiving slots thereof;

said radio transmitter remote control unit transmitting activation and deactivation codes on a predetermined radio frequency in response to depression of a remote activation switch;

said programmable control circuit being in electrical connection with said temperature sensor and said heating element through said three-conductor heating element and temperature sensor socket, a remote code set switch for allowing a user to select activation and deactivation codes, said radio receiver tuned to said predetermined radio frequency, and two of said light assemblies using said two two-conductor light assembly sockets;

said programmable control circuit being programmed to monitor said radio receiver for activation and deactivation codes and to turn on said light outputs when a light activation signal is received and to turn off said light outputs when a deactivation signal is received;

said programmable control circuit being further programmed to monitor a temperature signal generated by said temperature sensor when said on/off switch is in said on position and to activate said heat output when said temperature signal is below a threshold trigger temperature that is greater than said freezing temperature of water and to deactivate said heat output when said temperature signal is above said threshold trigger temperature.

* * * * *